US005711078A

United States Patent [19]

Patton et al.

[11] Patent Number: 5,711,078

[45] Date of Patent: Jan. 27, 1998

[54] PORTABLE EMERGENCY RESCUE CUTTING AND CRIMPING TOOL

[76] Inventors: Tommy L. Patton, 2480 Calle Narciso, Thousand Oaks; Peter J. Schneider, deceased, late of Thousand Oaks; by Marlene R. Schneider, executor, 2480 Calle Narciso, Thousand Oaks, all of Calif. 91360

[21] Appl. No.: 610,703

[22] Filed: Mar. 4, 1996

Related U.S. Application Data

[63] Continuation of Ser. No. 277,044, Jul. 19, 1994, abandoned, which is a continuation of Ser. No. 855,566, Mar. 23, 1992, abandoned, which is a continuation-in-part of Ser. No. 314,614, Feb. 23, 1989, Pat. No. 5,125,158.

[51] Int. Cl.[6] ..... B26B 13/00

[52] U.S. Cl. ..... 30/228; 30/192; 30/241

[58] Field of Search ..... 30/228, 241, 227.4, 30/292, 242, 243, 182, 180; 254/93 R

[56] References Cited

U.S. PATENT DOCUMENTS 2,711,583 6/1955 Raby ..... 30/92

4,198,748 4/1980 Lewis ..... 30/180

*Primary Examiner*—Douglas D. Watts

*Attorney, Agent, or Firm*—Richard S. Slehofer

[57] ABSTRACT

A tool for severing or crimping a workpiece includes a rigid mainframe having an elongate grooved channel running through most of its length. A wedge-shaped upright rigid head forms the front portion of the mainframe. The rear portion of the mainframe has an integral shaft guideway and a mount for mounting a hydraulic cylinder and components. The head and hydraulic mount form a U-shaped jaws area. The upright head has an elongate vertical slot. A cutting or crimping blade can reciprocate along the grooved channel of the mainframe and enter the head so that the blade can fully sever a workpiece placed in the gap between the blade and head. The blade can be a pointed V-shaped cutting blade or a flat crimping blade having a blunt leading edge. The base of the blade has a flange for cooperating with the grooved channel for guiding the blade. The blade is manipulated by a hydraulic piston which is positioned in a hydraulic cylinder mounted at the rear portion of the mainframe. The hydraulic pressure causes the shaft to extend or retract with the cutting blade attached to it. Additional features include handles to allow the operator to manipulate the tool.

7 Claims, 7 Drawing Sheets

PORTABLE EMERGENCY RESCUE CUTTING AND CRIMPING TOOL

CROSS REFERENCE TO RELATED APPLICATIONS

This application is a continuation of U.S. patent application Ser. No. 08/277,044, filed on Jul. 19, 1994, which is now abandoned; which is a continuation application of Ser. No. 07/855,566, filed Mar. 23, 1992, now abandoned; which is a continuation-in-part of U.S. patent application Ser. No. 07/314,614, filed on Feb. 23, 1989, now U.S. Pat. No. 5,125,158, issued on Jun. 30, 1992. A small entity status was previously filed in the parent application. It is requested that the small entity status be carried over and continued in this continuation application. Another small entity status is being filed concurrently with this application.

BACKGROUND OF THE INVENTION

1. Field of the Invention

The present invention pertains to the following areas of technology:

Hydraulic rescue equipment.

Cutlery: Pipe and rod cutters adapted to cut pipe or rod transversely; cutting tool with a blade guide; cutting tool with material receiving opening; cutting tool with blade moving means; cutting tool with one movable blade and slot; cutting blade moving means; cutting tool having a detachable blade.

Implements or Apparatus for Applying Pushing or Pulling Force; fluid pressure.

Hydraulic rescue equipment.

2. Description of the Prior Art

U.S. Pat. No. 2,711,583 issued to Raby discloses a cable cutter attachment for a portable hydraulic power unit.

U.S. Pat. No. 4,973,028 issued to Linster discloses a rescue tool jaw.

U.S. Pat. No. 4,198,748 issued to Lewis discloses a hydraulically actuated garden tool attachable to a garden hose for cutting twigs.

U.S. Pat. No. 4,608,754 issued to Kloster discloses a driven exhaust pipe cutter, which is pneumatically powered.

U.S. Pat. No. 3,807,046 issued to Igyarto et al. discloses a tube cutter for cutting relatively soft tubing, such as plastic tubing and rubber hose. The cutter has a cutting knife and is hand squeezed to cut the section of the workpiece positioned in the cutter's jaws.

U.S. Pat. No. 4,412,380 issued to Kish discloses a manually-operable handle having a removable cutting blade for cutting pieces of air conditioning hoses.

SUMMARY AND OPERATION OF THE INVENTION

A portable emergency rescue cutting and crimping tool for severing portions of the body of an automobile includes a one-piece C-shaped mainframe having a combined grooved channel and slotted opening running along its longitudinal length. The C-shaped mainframe includes an upright rigid head portion formed at the front end of the frame, a rigid lower horizontal mid-section, and an integral upright combined bell-shaped guideway and hydraulic cylinder mount positioned at the back of the C-shaped main frame. The upright rigid head has a combined vertical slotted opening and a lower opening for the grooved channel so that a cutting blade can reciprocate along the grooved channel. The cutting blade can enter and pass through the vertical slotted opening in the upright rigid head so that the cutting edge of the cutting blade can fully sever a workpiece which is placed in the gap between the movable blade, the rigid head, and the mid-section of the C-shaped mainframe. The body of the cutting blade can be flat with a pointed vertical and transversely bevelled cutting edge. Or the blade can be a crimping blade, in which case the body of the blade is flat with a straight vertical crimping edge. The transverse cross section of the crimping head is convex so that it will not cut the workpiece, but rather squeeze and crimp it. The base of either cutting or crimping blade has a horizontal flange so that either blade can travel back and forth along the grooved channel of the C-shaped mainframe to keep the blade in alignment when in operation so that it will traverse the path of the grooved channel. Either blade is manipulated by an extensible and retractable shaft extending from a cylindrically shaped hydraulic housing. The cylinder-shaped hydraulic fluid housing and its components are secured to the bell-shaped guideway and hydraulic cylinder mount at the rear of the mainframe. The movable shaft is hydraulically actuated by a pair of hydraulic lines attached to the rear of the cylindrical housing. By means of a control switch, the fluid pressure can enter the hydraulic cylinder causing the cutting blade to move toward the rigid upright head thereby severing the workpiece placed in its path. Additional features of the basic invention include handles for allowing the operator to manipulate the tool, accessories such as a portable hydraulic pump powered by a battery operated DC electric motor, an AC electric motor, or a small gasoline driven piston engine to turn the hydraulic pump to supply hydraulic fluid under pressure to the cutting tool.

The present invention can be used in an automobile dismantling operation, at a muffler repair shop, or as an emergency rescue tool to extricate accident victims who are trapped in a damaged vehicle, such as an automobile or an airplane.

The invention is essentially a rigid one-piece mainframe having an upright rigid head at one end and a bell-shaped cylinder mount and guide member at the other end. The mainframe can be fabricated as a single piece by a die cast process. A blade guide is formed as an open recess running the length of the mainframe. The rigid head has a slotted opening for allowing the cutting blade to pass through. The open end of a hydraulic cylinder is screwed into the rear of the mainframe. A hydraulic piston in the hydraulic cylinder has an extensible and retractable shaft and a cutting blade attached to it so that the cutting blade can slide in the blade guide of the mainframe while forced by the hydraulic shaft, hydraulic piston, and hydraulic or other fluid pressure received from external hydraulic or other fluid lines. The mainframe includes a longitudinal blade guide illustrated as an inverted T-shaped grooved channel. The upright head has a slotted opening merging with the end of the grooved channel. By means of this grooved channel and slotted opening in the upright head, the cutting blade can be guided along the mainframe, enter and pass through the rigid upright head. In the open retracted position, the hydraulic piston is fully retracted and therefore the cutting blade is also fully retracted. The opening between the cutting edge of the cutting blade and the upright head forms a mouth or closable jaw for inserting transversely a portion of the tail pipe or other section of a workpiece to be cut, or severed. The term "workpiece" is defined as the thing or article operated on, altered, changed, or reduced by the present invention.

The present invention can be used in the emergency situation where an accident victim is caught inside a twisted and torn automobile. The metal has to be cut away or otherwise bent in order to open up the door or the like to extricate the accident victim. In this situation, the present invention can be used to cut away portions of the door, roof, or pillar of the vehicle. The present invention would normally be sufficient equipment to provide access to remove the accident victim from the damaged vehicle.

Another object of the present invention is to easily sever sections of a tail pipe on either side of a catalytic converter to quickly remove the catalytic converter from an automobile during the dismantling process of scrapping an automobile. After the catalytic converter is severed, the precious metals and rare earth elements contained within the catalytic converter are removed and recycled.

The present invention can also be used to quickly cut away and remove a gasoline tank from an automobile, to cut away a steering wheel, or even to remove the trunk from an automobile.

The hydraulic or fluid pressure forces the cutting blade to quickly sever the metal or even steel tail pipe in the mouth of the tool without much effort. The rigid upright head acts as a brace against the workpiece and the approaching cutting blade, which together basically pinch, compress and cut the cross section of the tail pipe, or workpiece and easily cuts it into two sections.

The hydraulic or fluid pressure can be supplied from a portable power supply unit and fluid pump or hydraulic pump for use in field conditions. The power supply can be an electric motor energized by 110 volt A.C. household current, direct current, or a gasoline motor. An automotive battery can power an electrical motor which in turn can rotate the hydraulic or fluid pump for providing the necessary hydraulic fluid under pressure to a reservoir tank and to the expandable and retractable hydraulic or fluid piston mounted at the rear of the mainframe. Two hydraulic or fluid lines interconnect the hydraulic pump/reservoir and the hydraulic piston. An electrical on-neutral-off position switch, which is commonly referred to as a "dead man's safety switch", or an open centered switch is used for activating or deactivating the hydraulic fluid pump or reservoir, whether voluntarily or involuntarily. By controlling the "dead man's" switch, the cutting action and movement of the blade is also controlled.

The cutting blade can have a V-shaped, or an arrow shaped configuration. The cutting edge can been sharpened and bevelled on both sides so that the cutting edge is also V-shaped in its transverse cross section. The cutting blade is attached to the shaft extending from the hydraulic piston and can be unscrewed and removed. The blade is secured to the shaft by fasteners such as allen head screws, or nuts and bolts. The cutting blade can be removed from the tool by removing the fasteners securing the cutting blade to the shaft of the hydraulic piston and then the cutting blade can be slid out along the grooved channel of the mainframe and passed through the slotted opening in the upright rigid head of the mainframe. In this manner a replacement cutting blade can be quickly installed while the used blade is resharpened for later use. The grooved channel in the mainframe can be an inverted T-shape in cross section. The base of the cutting blade has a flange, which slideably engages the grooved channel. The blade flange and mainframe guideway combination aligns and guides the blade along its cutting path, and it also prevents the blade from disengaging from the mainframe. As stated, the cutting blade is removable and interchangeable with other types of blades. Depending on the type of workpiece to be cut, the cutting edge of the blade can be serrated, obliquely angled, bevelled on one face only, ribbed for strength, or convex shaped. In the second embodiment where the inside of upright head forms a C-shape, the cutting edge of the blade is not sharpened on both sides of the face, or double cut. Rather, only one face is sharpened in a bevelled manner.

DETAILED DESCRIPTION OF THE INVENTION

Figure 14:
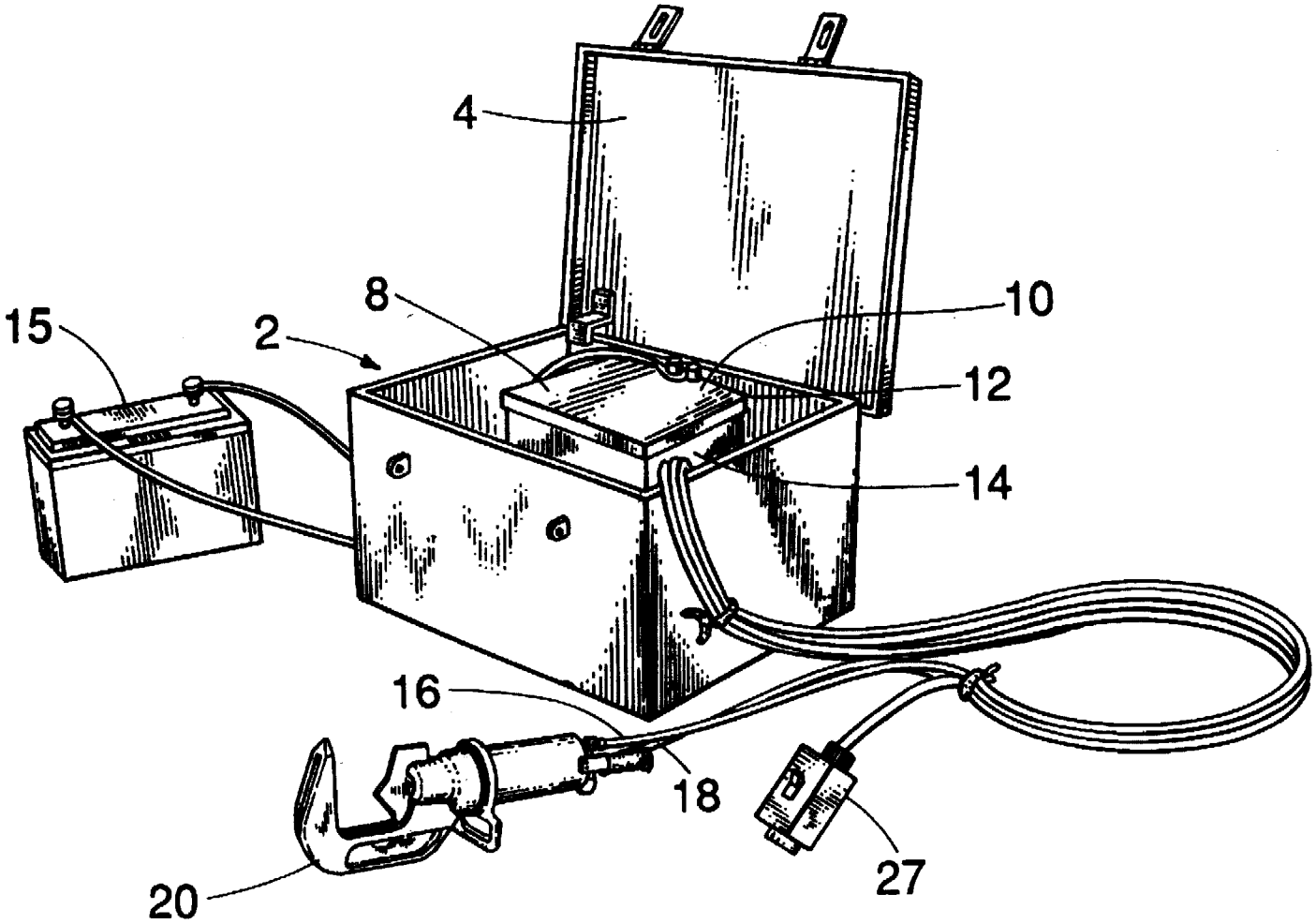
FIG. 14 is a perspective view of the present invention and the portable fluid pump, power source and fluid lines.

Referring now to FIG. 14 there is disclosed a perspective view of the present invention 20 along with the self-contained portable fluid or hydraulic pump and fluid or hydraulic lines 16 and 18. The present invention can be used under field conditions; for example at an automobile dismantling yard, at the scene of an accident, or in response to a 911 emergency telephone call. A storage box 2 is illustrated having a lockable hinged lid 4. Inside the storage box is a compartment 8 containing an electric motor 10, which drives an hydraulic pump 12. Neither one is visible in FIG. 14. An optional hydraulic reservoir can be integrated with the pump 12 and motor 10 to act as a circulating coolant for the equipment in the compartment. In operation, the hydraulic pump 12 is rotated at a predetermined constant speed by the drive motor 10. The hydraulic pump 12 provides hydraulic fluid at a preset constant pressure to a valve 14 (not shown) which can divert the hydraulic fluid to the cutter lines, or the valve can recirculate hydraulic fluid back to the pump. The diverter valve 14 is controlled by the operator actuating the remote control switch 27. Positioned outside the box for clarity purposes, is an automotive lead-acid battery 15 showing the terminals and cables going to the DC electric motor inside the compartment 8. Exiting from the hydraulic pump, or diverter valve, are a hydraulic line 16 for retracting the shaft 100 and attached blade 160, and a hydraulic line 18 for extending the shaft 100 and attached blade 160. Both are connected to the cutting and crimping tool 20. An operator's control switch 27 is also wired into the compartment 8. The control switch can be used to either engage and disengage the drive motor to the hydraulic pump 12, or to control the flow of hydraulic fluid to the tool 20 by controlling the diverter valve. The diverter valve also can be controlled by manual means when the invention is used underwater. The larboard or left side profile of the present invention 20 is shown also illustrated in FIG. 1.

The present invention 20 comprises the following major components: mainframe 30; pair of shaft bushings 60 and 62 inside the mainframe 30; hydraulic cylinder 80 threadably screwed into the rear of the mainframe; shaft 100 extending from the hydraulic fluid cylinder 80; piston 120 inside the cylinder 80; rod cap 140 screwed into the open end of the cylinder 80; cutting blade 160 or crimping blade 180 connected to the end of the shaft 100; switch 400; cylinder collar ring 90; and a pair of handles 500 and 530. The mainframe 30 is illustrated from various angles and cross-sections in FIGS. 2–7.

Figure 5:
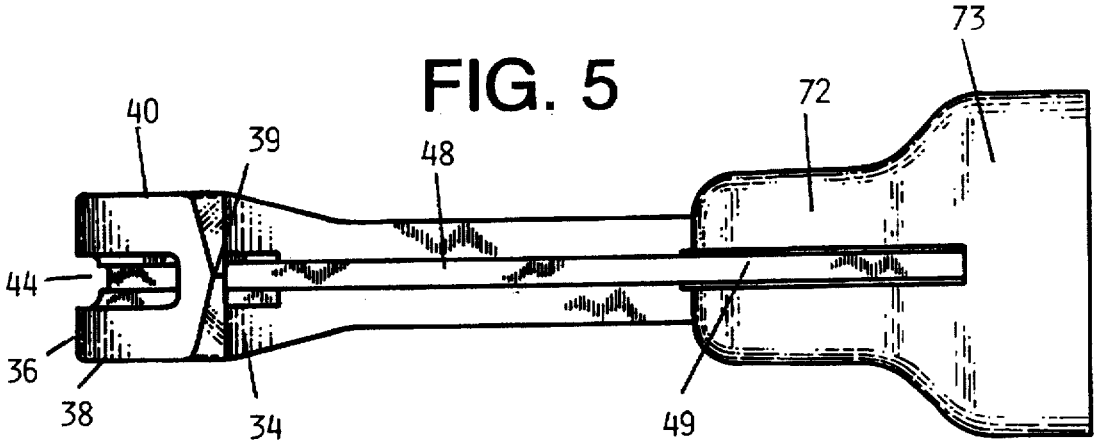
FIG. 5 is a top plan view of the mainframe illustrated in FIG. 2.

The mainframe 30, which forms the body of the tool now will be discussed in further detail. The mainframe 30 is forged or otherwise fabricated and machined from a single piece of metal. In a preferred embodiment, the mainframe 30 is fabricated from heat treated stainless steel for the ultimate in strength. After machining, The surface of the stainless steel mainframe is buffed and polished to give it a shiny appearance. The mainframe is symmetrical about an imaginary vertical longitudinal plane placed down the center of the mainframe. FIG. 5 illustrates the symmetry. The mainframe 30 is about 12 inches in length, about 4 inches in height, and about 4 inches wide at its rear portion. The mainframe weighs about 14 pounds when it is fabricated from stainless steel.

Figure 6:
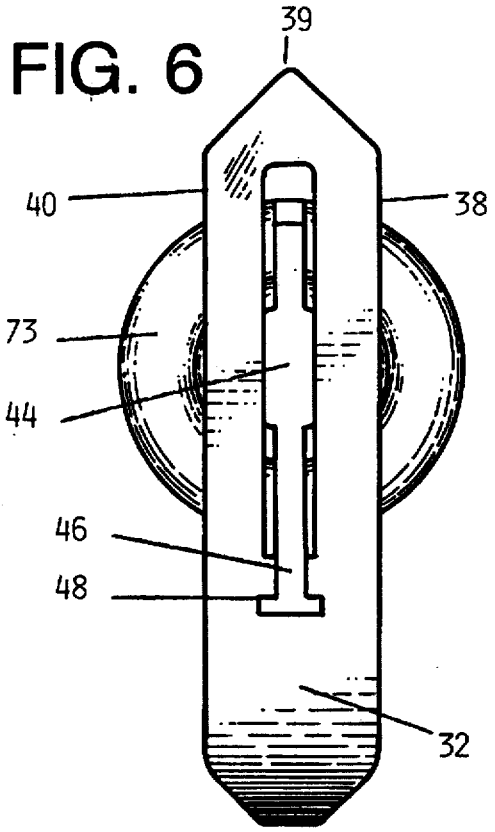
FIG. 6 is a front elevational view of the mainframe illustrated in FIG. 2.

The mainframe can be defined as having a front portion, a mid-section, and a rear portion. The front portion includes an upright rigid head 32. The rigid head 32 has a wedge-shaped appearance in profile as illustrated in the mainframe side view in FIG. 2. The inboard face or edge 34 of the rigid head 32 is flat transversely and is straight and vertical in profile. The outboard face or edge 36 of the rigid head is flat transversely and forms a vertical convex curve in profile. Both edges 34 and 36 merge at the top to form a pointed tip 39. This is clearly illustrated in FIG. 6, which illustrates the front of the head 32 along with the rest of the mainframe 30 as a front elevational view. The front elevational view of the rigid head gives the appearance of an elongate rectangle as shown in FIG. 6, and as a generally square rectangle in the top elevational view of FIG. 5. The left side wall 38 and the right side wall 40 of the head are angularly cut towards the top to form the pointed tip 36. The upright rigid head 32 also has a vertical slotted opening 42 running from its base to near the tip 36 of the head 32. The slotted opening comprises the main larger rectangular portion 44, which is wider than the thickness of the cutting blade. The opening constricts to a smaller rectangular portion 46 towards the bottom. A slot 48 is at the bottom. The constricted portion 46 and the slot 48 in combination form an inverted T-shaped slot forming part of the blade guideway. The blade guideway is clearly shown in FIG. 5. The upper portion 44 of the rectangular opening has a height of four inches and a width of ½ inch. The lower constricted portion is ¼ inch wide and ⅜ inch high. The slot 48 is ¾ inch wide and ¼ inch high. These overall dimensions for the slotted opening 42 are sufficient to allow the cutting blade 160 or the crimping blade 180 to enter and pass through the upright rigid head 32. The width of the wide portion 44 of the slotted opening 42 is enlarged to about twice the width of the blade 160 or 180. This enlarged opening 42 allows a portion of the workpiece to be forced into the slotted opening in the inside face of the blade. This enlarged slotted opening 42 is a safety feature, because it reduces the possibility that the severed workpiece pieces may become dangerous projectiles after they have been cut. The lower curved profile of the outboard edge 36 becomes more acutely curved as it merges to form the bottom outline of the mid-section of the mainframe. The side walls 38 and 40 of the head also become more narrowed as the side walls merge to form the mid-section of the mainframe 30.

The overall shape of the head 32 is important to the invention. The head functions much like the claw of a claw head hammer functions. The head is about 8 inches in height and about 2 inches in width. The large head tapers to the narrow mid-section of the mainframe 30. The present invention can be swung and manipulated by the operator so that the tip 39 of the head 32 can be wedged into a tight area. The weight of the head 32 increases the momentum of the swinging movement by the operator. The tip 39 then can be manipulated to work and pry the rest of the head 32 into the tight area so that the workpiece to be cut is properly aligned in the cutting area of the present invention so that it can be cut with the blade 160. The shape and size of the mainframe 30 assists the operator in positioning the tool at the right location for cutting the object being worked on. The head 32 also can be used to pry apart pieces that are bent, damaged, or hard to reach. The size, shape and strength of the head 32 is also important during the cutting operation. The inside face 34 acts as an stationary surface against which the workpiece is being squeezed by the extending cutting blade 160 during the cutting operation. The base of the inside face 34 forms a right angle with the top 54 of the mid-section of the mainframe 30. The concave forward corner 35 between the inside face 34 and the top 54 is curved so that an edge of the workpiece can lodge there during the cutting or crimping operation. For example, when cutting the straps holding a fuel tank to the underside of an automobile, the operator can wedge the tip 39 of the head between the strap and the tank. The operator can then use the head 32 as a lever by rocking the tool back and forth while forcing the rest of the head 32 between the strap and the tank until the strap is located at or near the concave corner 35 on the mainframe 30. The outside curved edge 36 of the head 32 assists the head 32 in working its way between the strap and the tank. The final step is to actuate the blade 160 to sever the band.

The mid-section of the mainframe 30 will now be discussed in further detail. As previously stated, the mainframe is symmetrical on each side of an imaginary central vertical longitudinal plane. The left side elevational view of the mainframe looks the same as the right side elevational view. The top of the mid-section is clearly illustrated in FIG. 5, and the side elevational view of the mid-section is clearly illustrated in FIG. 2. The bottom edge 52 of the mid-section is generally straight, flat and planar. Both ends of the bottom edge each then curve upwardly towards the front and towards the rear of the mainframe. The top inside edge 54 of the mid-section is about 4 inches in length and about 1¼ inches in width. The mid-section has a pair of symmetrically opposed hand grip recesses labelled 56 and 58. Both recesses are positioned below the top edge 54. Each recess is a generally oval-shaped depression. The surfaces of both recesses are not polished. They have a matte finish, which is rough in texture to provide the operator with a better gripping surface. The bottom edge 52 is about ¾ inch in width. The cross-sectional view in FIG. 4 clearly illustrates the opposed hand grip recesses 56 and 58 positioned above the bottom edge 52.

Figure 7:
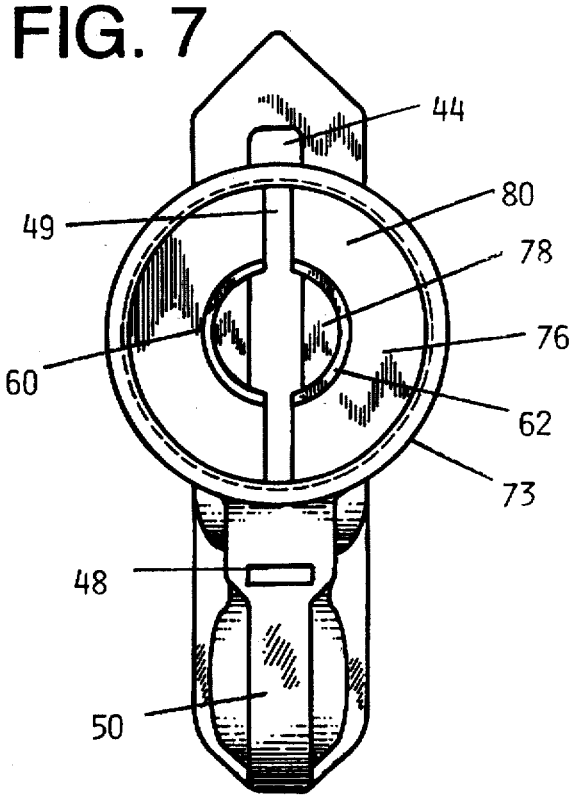
FIG. 7 is a rear elevational view of the mainframe illustrated in FIG. 2.

The top edge 54 of the mid-section also functions as a support brace for the mainframe. The open inverted T-shaped channel also passes through the mid-section. The exposed portion of the inverted T-shaped channel 48 is shown in FIG. 5 of the plan view of the mainframe. The front and rear of the inverted T-shaped channel 48 is also shown in FIGS. 6 and 7.

Figure 9:
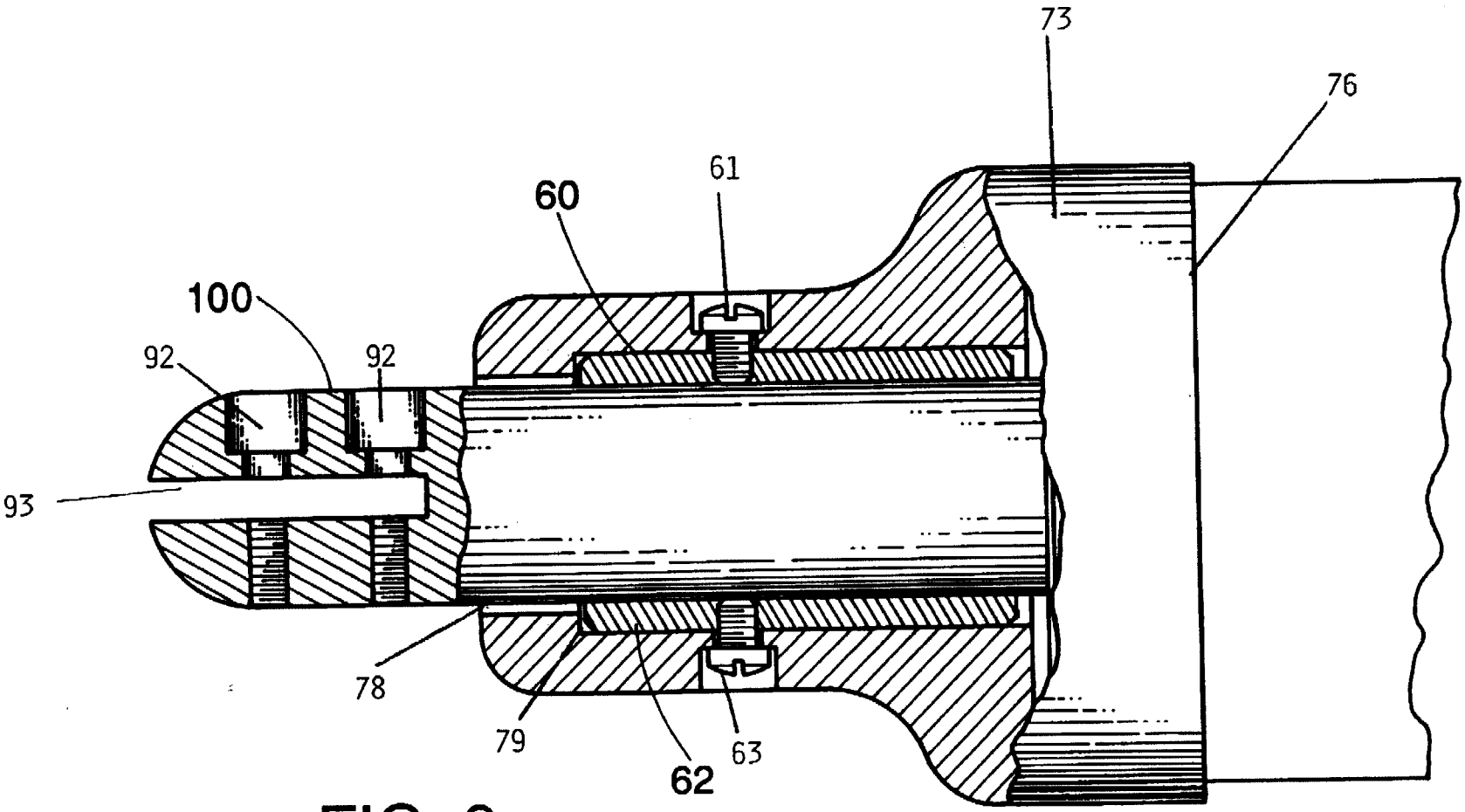
FIG. 9 is a partial longitudinal sectional view of the mainframe illustrating the pair of opposed bushings and guideway for the fluid shaft.

The rear portion of the mainframe 30 will now be described in further detail. The rear portion includes a bell-shaped configuration positioned horizontally so that the large part 73 of the bell-shaped configuration opens at the rear of the mainframe, and the neck 74 of the bell-shaped configuration faces the upright rigid head 32. The bell-shaped configuration labelled 73 and 74 mount 72 functions as a mounting for the hydraulic cylinder 80 and is also a guideway for the hydraulic shaft 100. The lower edge of the bell configuration is integral with the mainframe 30. The bell-shape is a result of three concentric and tandemly placed cylindrical bores. The neck 74 and the larger mouth component 73 are clearly illustrated in FIG. 2. The flared open end or female threaded mouth 76 of the bell configuration is clearly illustrated in FIG. 7. The forward cylindrical bore 78 is 1½ inches in diameter and is ¾ inch in length. This bore 78 acts as a guideway for the extensible and retractable hydraulic or fluid shaft 100. The middle bore 79 is 1¾ inches in diameter and 2¾ inches in length. The middle bore houses a pair of opposed hemicylindrically-shaped replaceable bushings. The pair of bushings 60 and 62 are illustrated in a partial cutaway view in FIG. 9. Each bushing is secured to the inside wall of the bore 79 by screws 61 and 63 illustrated in FIG. 9. The diameter of the middle bore after both bushings are installed is slightly less than the diameter of the front bore 78. Each bushing 60 and 62 is made of a material that is softer than the shaft 100 or the mainframe 30. The bushings are intended to be the sacrificial friction points and to wear out through use of the tool. The bushings 60 and 62 can be replaced at the required wear intervals. The other components of the present invention are fabricated from more durable metals so that they will last indefinitely, while the bushings 60 and 62 are intended to be replaced often. The shaft does not touch the wall of the forward bore. The bushings take all the wear and tear.

The open flared end or mouth 76 of the bell-shaped configuration will now be discussed in detail. The open flared end is intended to threadably receive the threaded open end of the hydraulic cylinder 80. The diameter of the cylindrically-shaped open end is about 3½ inches and is about one inch deep. The interior wall of the mouth 76 is threaded as a female connection to receive the open outer threaded male end of the hydraulic cylinder 80. The interior face in the bell configuration where the rear bore meets the middle bore is a flat circular surface 80. FIG. 7 illustrates the rear elevational view of the mainframe. The open end 76, the face 80, and the bore 78 are clearly visible.

Figure 8:
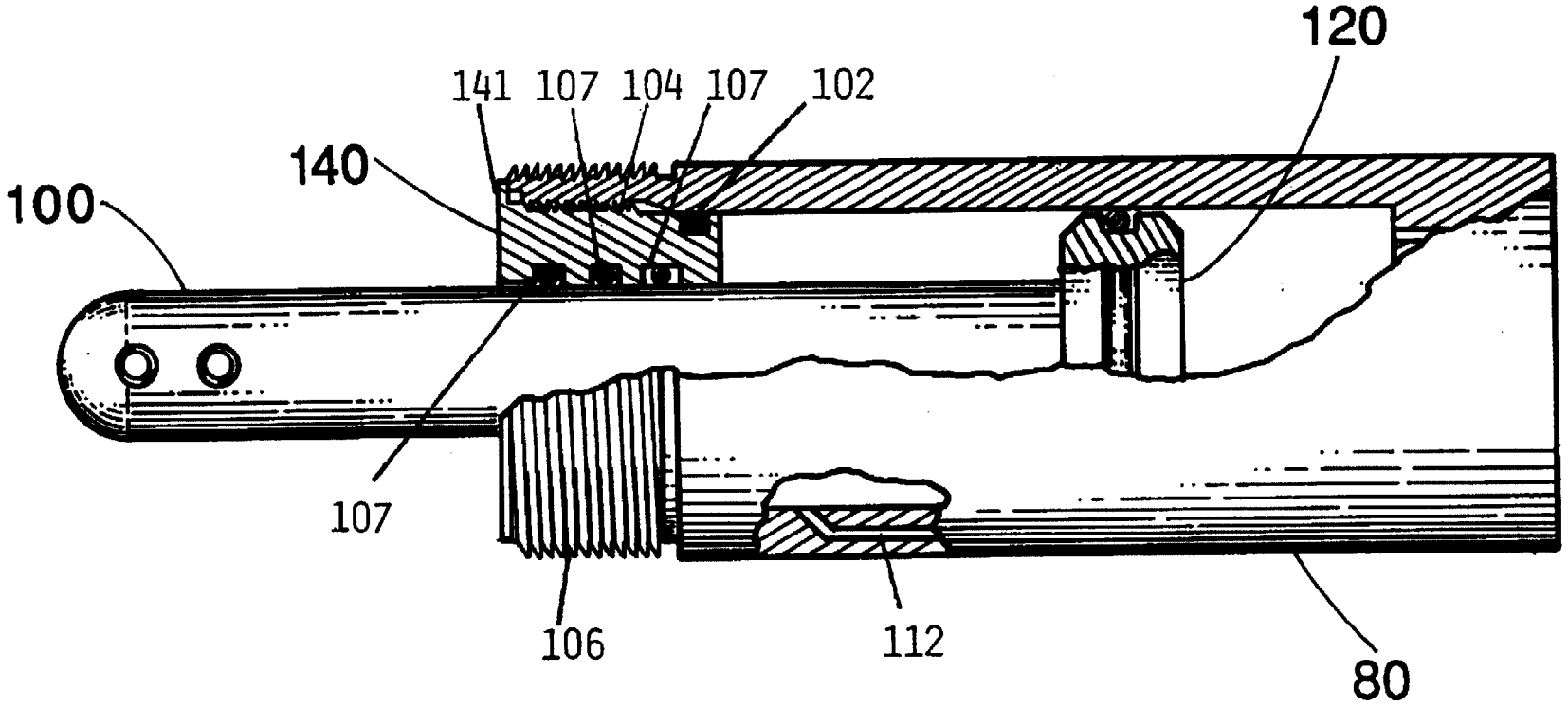
FIG. 8 is a partial longitudinal sectional view of the fluid cylinder illustrating the cylinder rod cap, the fluid piston, and the fluid shaft and blade holder.

The hydraulic cylinder means is used for moving the cutting blade. The hydraulic cylinder means is illustrated as a hydraulic cylinder 80, a cylinder collar ring 102, the cylinder cap 140, and a hydraulic piston 120. These components are illustrated in FIG. 8. The open end of the cylinder 80 has a male threaded connection 104 for threadably connecting to the female threaded mouth 76 of the bell-shaped rear portion of the mainframe 30. The cylindrical threaded opening 76 receives the threaded end 104 of the hydraulic cylinder. The interior of the mouth of the hydraulic cylinder 80 also is threaded and has a slightly larger diameter than the cylindrical interior. The cylinder contains passageways for the hydraulic fluid. Passageway 112 is illustrated in FIG. 8. The inside of the cylinder tapers at the interior end where the threads stop. The cylinder rod cap 140 has threads 106 on its outside cylindrical surface and has a circular beveled interior end where the cylinder portion meets the end face. The cap is clearly illustrated in FIG. 8. The cap has a flanged rim 141 at its outer end. A circular groove is placed inboard from the beveled end. A sealing gasket 102 is placed in this groove. The cap has a concentric bore with three circular grooves in the wall of the bore for holding sealing gaskets 107. The cap supports the shaft 100 and also prevents hydraulic fluid from leaking out.

The hydraulic shaft is illustrated FIG. 8. The shaft means is illustrated as a cylindrical shaft 100 having a mounting means for mounting the cutting means to one end of the shaft. The shaft 100 extends from the left side of the hydraulic cylinder, and faces towards the upright rigid head 32 as illustrated. The hydraulic cylinder has connections 110 for connecting to at least one hydraulic line to power the tool to move the cutting blade to sever a workpiece placed in the cutting tool's jaw. The rear of the shaft 100 has a male threaded end for receiving the hydraulic piston 120. The piston has a concentric cylindrical depression on its forward face. The depression has female threads. The piston is threadably secured to the end of the shaft 100. The outer surface of the piston 120 has at least one cylindrical groove for holding a gasket.

Figure 10:
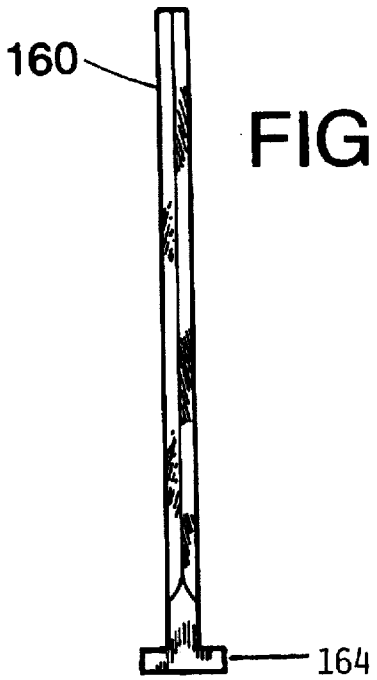
FIG. 10 is a front elevational view of the cutting blade.
Figure 11:
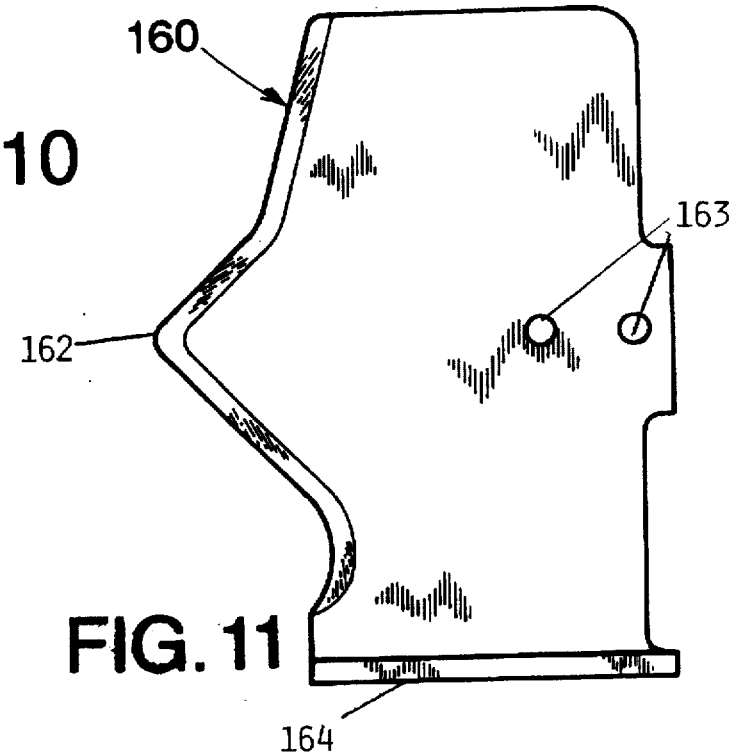
FIG. 11 is a left side elevational view of the cutting blade shown in FIG. 10, the right side being a mirror image thereof.
Figure 12:
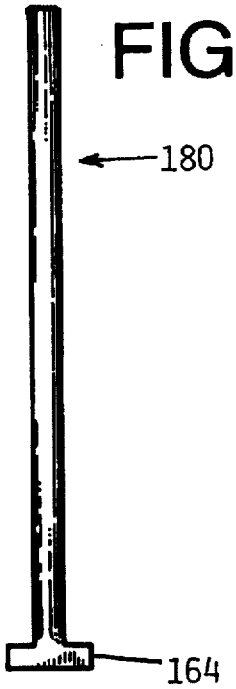
FIG. 12 is a front elevational view of the crimping blade.
Figure 13:
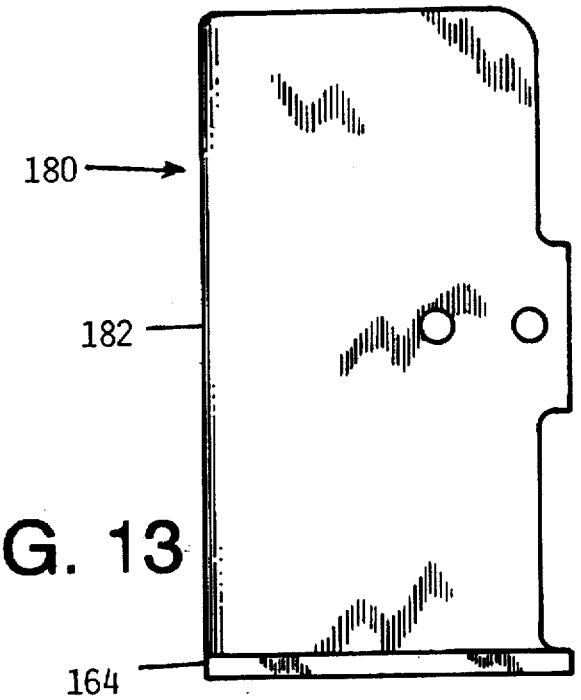
FIG. 13 is a left side elevational view of the crimping blade shown in FIG. 12, the right side being a mirror image thereof.

The cutting means is illustrated in FIGS. 10 and 11 as the cutting blade 160. It is shown as being generally V-shaped with a bibeveled cutting edge. The pointed tip 162 on the cutting edge can be used to cut many types of workpieces, and tip can hold the workpiece in the slotted opening 44 in the head 32. The base of the cutting blade is an inverted T-shaped flange 164, which cooperates along an open inverted T-shaped grooved channel 48 cut lengthwise in the mainframe 30. This is generally described as the blade guide means formed by an open recess running the length of the mainframe 30. The guideway terminates just before the face of the cylindrical opening in the bell-shaped portion of the mainframe. The length and position of the guideway is clearly illustrated in FIG. 5. The guideway and the shaft guideway are in a spaced parallel relationship. This combination of the inverted T-shaped flange 164 and the inverted T-shaped grooved channel 48 prevents the cutting blade 160 from disengaging from its track when in operation.

The blade guide can be any type of a blade guide means for providing a guideway for the cutting blade. It could have many configurations in cross section. For example, key-hole shape; inverted V-shape; or cross shape. The corresponding flange means at the base of the cutting blade would then have a complementary matching configuration in cross section.

Figure 1:
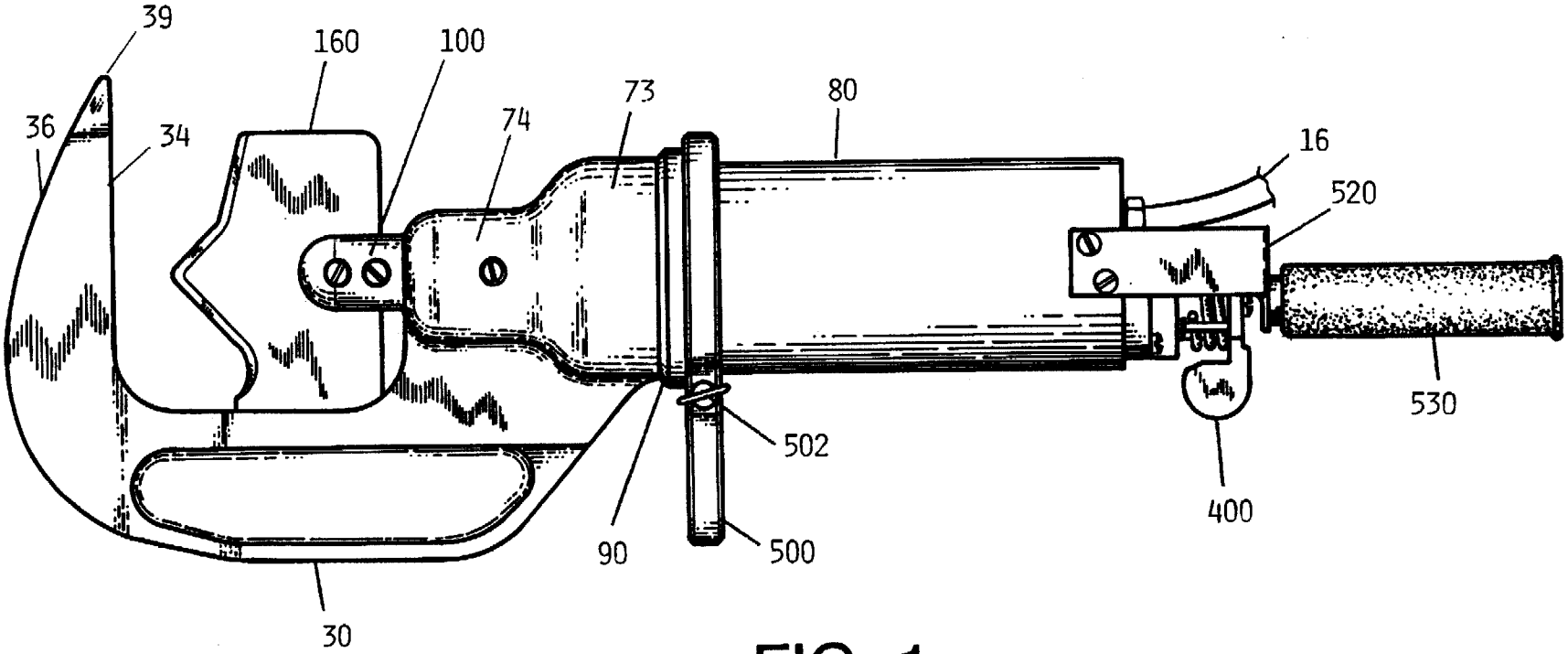
FIG. 1 is a left side elevational view of the present invention.
Figure 2:
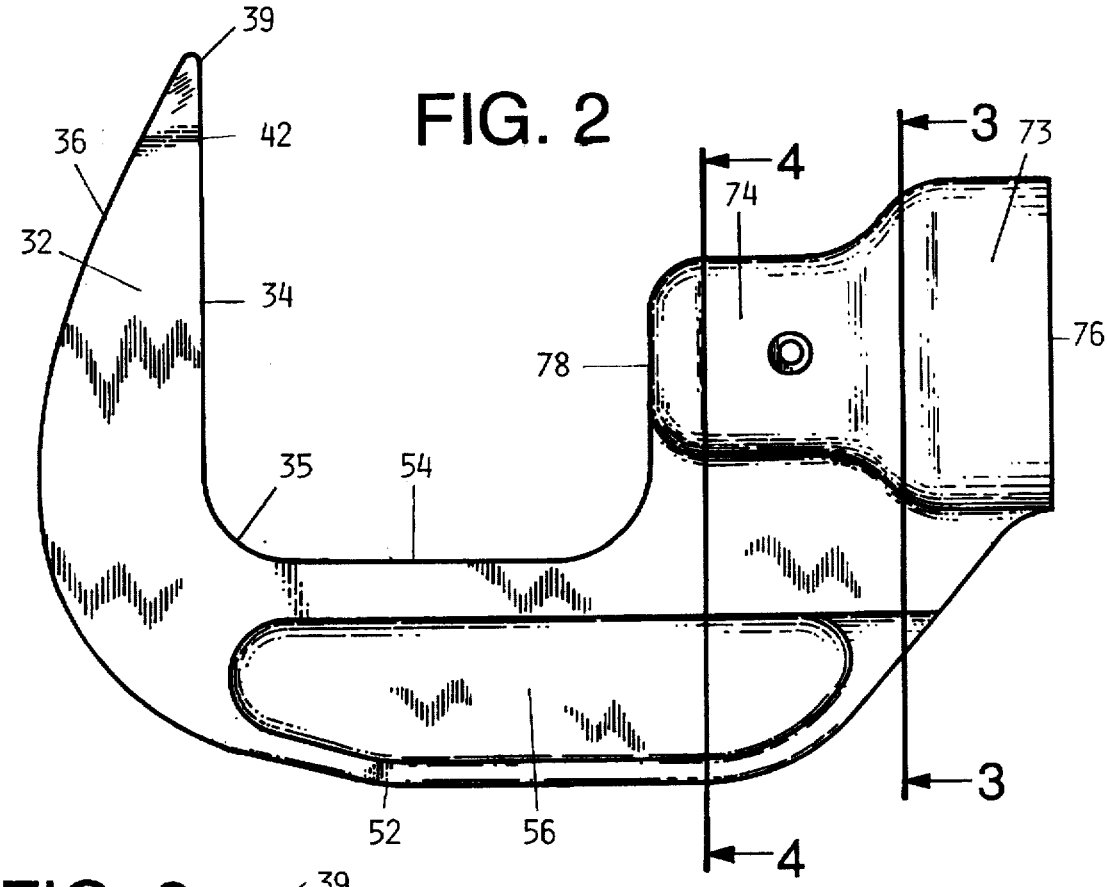
FIG. 2 is a left side elevational view of the mainframe.
Figure 3:
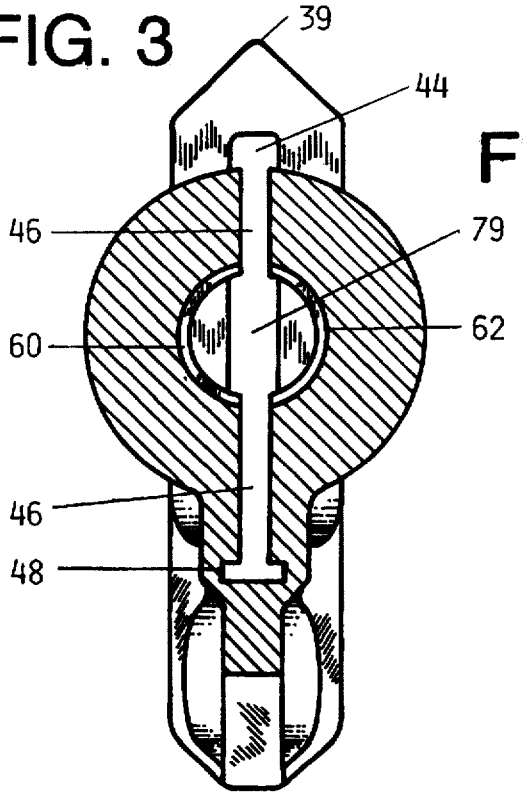
FIG. 3 is a cross-sectional view taken along line 3—3 in FIG. 2.
Figure 4:
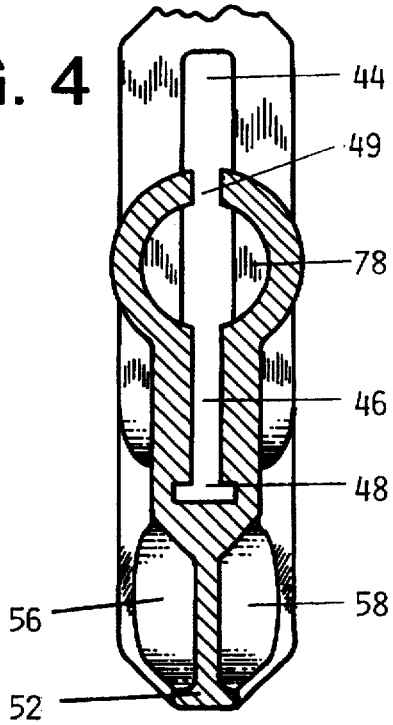
FIG. 4 is a cross-sectional view taken along line 4—4 in FIG. 2.

In FIG. 1, the cutting blade 160 is at its open at rest position. This tool is commonly used to sever transversely an exhaust pipe or tail pipe, remove a gasoline tank, cut away a steering wheel, or remove a trunk from an automobile or other vehicle. It is quite frequently used in salvage operations in a auto wrecking yard where a catalytic converter is to be removed and the rare earth elements in the catalytic converter are reclaimed. The opening of the tool, that is, the U-shaped area formed between the cutting blade 160, the upright rigid head 32, and the mid-section of the mainframe is transversely positioned around the tail pipe or workpiece. The operator's control switch 27 and deadman's switch 400 attached to the hydraulic cylinder 80 is then actuated. The hydraulic fluid forces the hydraulic piston 120 in the cylinder 80 to move causing the hydraulic shaft 100 to extend, and the attached cutting blade 160 to move forward along its guideway and engage and sever the piece of the tail pipe held in the opening of the jaws. This operation is quite rapid and can be done in a matter seconds. The cutting speed of the blade can be modified by design, but normally travels at one inch per second. The slotted opening 44 in the rigid upright head 32 allowing the cutting edge to enter and pass through as the work piece is being severed. This allows for a complete pass of the cutting blade through the section of the workpiece being severed.

After one section of the exhaust pipe has been severed, the operator reverses the deadman's switch 400 to retract the cutting blade so that the cutting tool again is ready for use on the other side of the catalytic converter. The cutting and severing operation is repeated on the other section of exhaust pipe. The catalytic converter then drops out of place. In other applications, the hydraulic piston 80 could be coupled to hydraulic pressure lines, for example, as found in a muffler shop. In this application the invention would normally be used to discard or sever pieces of exhaust pipes and tail pipes so that they can be removed and replaced with a new section of tail pipe and/or muffler. When the tail pipe is being severed on a car for a muffler repair, then the remaining cut end section of the tail pipe left in tact on the automobile should be left as rounded as possible so that the new replacement rounded section end of the replacement tail pipe can be easily matched up and welded to the stump left on the automobile.

The shaft 100 has a groove 93 so the medial back area of the cutting blade 160 can be centered in it and fastened to the shaft. There are two allen head screws 92 for holding the cutting blade 160 in position. The cutting blade 160 can be removed from the hydraulic cylinder shaft by the removal of the two screws 92. The cutting blade 160 glides along an inverted T-shaped grooved channel 48 and the blade guideway 49 cut lengthwise in the mainframe. The cutting blade is forced forward when severing the transverse section of the workpiece. The guideway 49 and grooved channel 48 guide the cutting blade along its predetermined cutting path.

When the operator energizes the remote control 27, or "dead man's" switch 400, the hydraulic fluid flows through the extension line 18 and into the hydraulic piston, which forces the hydraulic shaft 100 to extend outwardly away from the hydraulic cylinder 80 causing the cutting blade 160 to travel along its guide way 49. The hydraulic piston and the hydraulic pressure is sufficient to easily sever a workpiece or other parts to be severed without any difficulty. In fact, from the initial open travel position of the cutting blade until it severs the workpiece, the time extended is roughly 5 seconds to make a final cut.

The present invention finds special use in the emergency situation where an accident victim is trapped inside an automobile involved in an accident. The cutting tool can remove portions of the automobile, and the head 32 can bend or spread apart interfering portions of the automobile in order to extricate the trapped victim, or to provide access for the paramedics to evaluate and provide emergency care to the victim. The head 32 can be wedged into the cracked opening of a door which has been jammed and will not open. The head can pry the door open, or rip it off its hinges if necessary.

The present invention can be used in general to dismantle and remove various components from automobile bodies. The open gap between the upright rigid head and the cutting blade is of sufficient dimensions to enclose a windshield pillar, or door pillar and the cutting action can sever either one of these to remove the roof of an automobile. It can also be used to sever tubing, hinges and the like to remove the trunk, doors, hood, gas tank, and steering wheel of an automobile while in the process of being dismantled. It can also be used to cut away security bars over windows in case of a fire, and to dismantle and cut electric wires and cables.

The cutting blade illustrated in FIGS. 10 and 11 is replaceable to allow the present invention to be used in an industrial setting to cut various types of material such as pipe, wire, wood plastics, metal bars, tubing and the like. The blade has a pair of mounting holes 163 for attachment to the head of the shaft 100 extending from the hydraulic cylinder 80. Additionally, each blade has a flange for mating with the inverted T-shaped grooved channel in the mainframe. A crimping blade 180 has a flat vertical edge 182. It does not have a cutting blade. The leading edge is rounded. A line that has to be crimped off can be placed in the jaws area of the tool. The crimping blade will squeeze the line against the head 32 to stop any flow in the crimped line. The cutting tool can be primarily used in an emergency situation; for example at the scene of an automobile accident, or an airplane wreck. Frequently the victim in an automobile accident is caught or "pinned" inside the damaged automobile and cannot be extricated because the roof has collapsed, the steering wheel has been bent in its place, or the doors are not openable, because they have been bent or otherwise deformed in some manner. In this situation the cutting tool could be used as a cutting instrument to remove the roof of a car by severing the windshield pillars and door pillars, which support the roof and are integral with the body of the automobile and thereby allowing the victim to be extricated from the automobile to pry open a jammed door or even to separate it from its hinges.

A safety relief valve inside the hydraulic pump limits the amount of hydraulic pressure to 6,000 p.s.i. Of course, various kinds of pressure relief valves can be installed having different maximum pressures as determined by the intended use for the tool and the size of the tool and hydraulic piston. The pressure relief valve prevents the tool from being used to sever a workpiece that cannot safely be cut with the tool. Once hydraulic pressure exceeds the limit of the pressure relief valve, the cutting blade stops moving forward and the hydraulic fluid is diverted back to the hydraulic pump.

Another safety feature of the tool comes into play when the operator is working underneath an automobile chassis which has been raised or stacked high above ground level. Even after the cutting operation has been completed, the severed workpiece stays in the gap of the tool. This causes the tool to remain in place until the cutting blade is retracted by the operator. This prevents the cutting tool from falling to the ground as soon as the severing of the workpiece has been completed. The operator can hold on to the tool, and then retract the blade to release the tool from the workpiece by operating the control switch. A falling cutting tool could severely injure someone or damage the tool itself. The switch can be a center type of switch which requires the operator to hold the switch in the forward or reverse position. If he releases his hand from the switch, the cutting blade stops moving. This is another safety feature.

The control switch can also be positioned adjacent the tool and in line with the hydraulic lines. In this arrangement, the tool is held in one hand while the other hand actuates the switch to move the blade.

The present invention has two brackets to assist the operator when using the tool. The first bracket 500 has a circular opening to slip over the cylinder 80. The bracket has a rectangular opening 502 so that the operator can grip it with his hands. A butterfly screw 502 is on the bracket so that the bracket can be rotated and slid on the cylinder to any location and tightened down. A U-shaped bracket 520 and handle 530 are attached to the rear end of the cylinder 80. The hydraulic control switch 400 is mounted adjacent to the bracket 520.

What is claimed is:

1. A portable emergency rescue cutting and crimping tool comprising:

a one-piece rigid mainframe having a front portion, a mid-section, and a rear portion;

said front portion, said mid-section, and said rear portion forming a generally U-shaped opening for receiving a workpiece;

wedge-shaped upright rigid head means at said front portion of said mainframe;

a transverse brace having indentations located at said mid-section of said mainframe for allowing the operator of the tool to firmly grasp the tool with one hand;

bell-shaped mounting means at said rear portion of said mainframe and integral with said mainframe for securing a hydraulic means;

extensible and retractable hydraulic means secured to said bell-shaped mounting means on said mainframe at the end opposite that of said upright rigid head means for providing power to said tool;

cutting blade means attached to said hydraulic means for cutting or crimping a workpiece placed in said U-shaped opening of said mainframe;

said mainframe having a blade guide means longitudinally positioned for providing a guideway for said cutting blade means;

said cutting blade means having a cutting edge;

slot means in said upright rigid head means for allowing said cutting blade means to enter; and said cutting blade means being moveable along said blade guide means while under power from said hydraulic means.

2. The tool as recited in claim 1 wherein said hydraulic means includes:

a cylinder containing said hydraulic piston means;

mounting means for mounting said hydraulic piston housing to said bell-shaped rear portion of said mainframe;

a hydraulic piston positioned in said cylinder and having an extensible and retractable shaft;

said shaft having a cut groove means at said extensible end for mounting said cutting blade means to said shaft;

said cylinder having hydraulic pressure line means for supplying hydraulic pressure to said hydraulic piston means for causing said shaft to extend or retract under hydraulic pressure thereby moving said cutting blade forward and backward along said blade guide means; and said hydraulic pressure being sufficient to force said shaft to extend and allow said cutting blade means to sever a workpiece positioned between said rigid upright head means and said cutting blade means.

3. The portable emergency rescue cutting and crimping tool as recited in claim 1 further comprising:

handle means for allowing the operator to hold and manipulate said cutting tool when in operation;

switch means to control the amount of hydraulic pressure and fluid being exerted on said hydraulic piston to control the forward and reverse movement of said cutting blade within said blade guide means.

4. The cutting tool as recited in claim 1 wherein said blade means includes:

an arrow-shaped flat blade having a bibeveled V-shaped cutting edge and a leading pointed tip.

5. A cutting tool comprising:

rigid mainframe having a front portion, a mid-section and a rear portion;

an upright wedge-shaped member positioned at said front of said mainframe;

fluid piston and housing securement means toward said rear portion of said mainframe;

said mainframe having a guideway means cut lengthwise for providing a guideway for a blade to reciprocate back and forth therein;

housing means secured to said securement means on said mainframe;

fluid actuated piston means in said housing and having an extensible and retractable shaft facing said upright head;

blade means secured to said extensible and retractable shaft extending from said fluid piston means for cutting or crimping a workpiece;

vertical slot means in said upright fixed member for allowing said blade means to pass into said upright fixed member;

said blade means having a flange means and being reciprocative along said guideway of said C-shaped mainframe means while being actuated by said shaft;

said fluid piston being movable in response to fluid pressure causing the extension of said shaft and blade for moving said blade towards said upright frame for cutting or crimping a transverse section of a workpiece placed in the opening between said upright fixed member and said blade; and said blade being retractable to its at-rest position after use.

6. The tool as recited in claim 1 further comprising a pair of opposed spaced apart hemicylinder-shaped bushings located in said mainframe and positioned around said shaft for aligning said shaft during movement.

7. The tool as recited in claim 5 further comprising a pair of opposed spaced apart hemicylinder-shaped bushings located in said mainframe and positioned around said shaft for aligning said shaft during movement.

* * * * *